US006935264B2

(12) United States Patent
Harris

(10) Patent No.: US 6,935,264 B2
(45) Date of Patent: Aug. 30, 2005

(54) SYSTEM FOR REFUELING A MARINE VEHICLE WITHOUT SPILLAGE

(76) Inventor: Mark Harris, 110 NE. 2nd Pl., Dania Beach, FL (US) 33004

( * ) Notice: Subject to any disclaimer, the term of this patent is extended or adjusted under 35 U.S.C. 154(b) by 73 days.

(21) Appl. No.: 10/696,285

(22) Filed: Oct. 29, 2003

(65) Prior Publication Data

US 2005/0103253 A1 May 19, 2005

(51) Int. Cl.[7] ..... B63B 17/00

(52) U.S. Cl. ..... 114/343; 114/364; 141/86; 220/4.14

(58) Field of Search ..... 114/343, 364, 211; 440/88 F; 141/43, 44, 55, 59, 65, 86, 311 A; 137/312, 313, 587–589, 565.23; 220/560.03, 220/562, 573, 4.14, 745, 746, 749, 913; 222/108, 222/109

(56) References Cited

U.S. PATENT DOCUMENTS 2,068,951 A 1/1937 Hansen
3,881,528 A 5/1975 Mackenzie
4,082,122 A * 4/1978 McGahey ..... 141/5
4,084,531 A * 4/1978 Fujiura et al. ..... 114/211
4,100,758 A * 7/1978 Mayer ..... 62/47.1
4,223,706 A 9/1980 McGahey
4,877,146 A * 10/1989 Harris ..... 220/746
4,963,169 A * 10/1990 Granville ..... 96/178
5,014,742 A * 5/1991 Covert et al. ..... 137/588
5,070,806 A 12/1991 Coster
5,230,372 A * 7/1993 Westphal ..... 141/86
5,322,099 A 6/1994 Langlois
5,449,029 A * 9/1995 Harris ..... 141/198
5,462,100 A * 10/1995 Covert et al. ..... 141/59
5,469,800 A * 11/1995 Brotz ..... 114/74 R
5,507,324 A 4/1996 Whitley
5,570,730 A 11/1996 Keehn, Jr.
5,603,349 A * 2/1997 Harris ..... 137/588
5,651,400 A * 7/1997 Corts et al. ..... 141/59
5,715,876 A 2/1998 Burt
5,727,603 A 3/1998 Langlois
5,738,154 A * 4/1998 Garvey, III ..... 141/86
5,762,114 A * 6/1998 Petersen ..... 141/86
5,765,604 A 6/1998 Garvey, III
5,850,858 A * 12/1998 Zeigler ..... 141/86
5,865,222 A * 2/1999 Diamond ..... 141/86
5,878,795 A * 3/1999 Armellino ..... 141/86

(Continued)

*Primary Examiner*—S. Joseph Morano
*Assistant Examiner*—Ajay Vasudeva
(74) *Attorney, Agent, or Firm*—Norman E. Lehrer

(57) ABSTRACT

A system for refueling a motorized marine vehicle without spilling fuel into the water is disclosed. A fuel tank is typically located within the vehicle and includes a filling tube and a vent tube secured thereto. A vent hole is formed in the vehicle and the vent tube of the fuel tank is in fluid communication with the vent hole. The present invention includes a tube in fluid communication with the vent hole of the marine vehicle for transporting any fuel located within the vent tube to a remote location. A vacuum source is connected to the tube. The vacuum source is adapted to draw the fuel through the tube and into a receptacle attached to the vacuum source.

4 Claims, 1 Drawing Sheet

U.S. PATENT DOCUMENTS 5,894,809 A 4/1999 Grigaitis et al.
5,975,154 A 11/1999 Bennett
6,152,196 A * 11/2000 Kehoe ..... 141/198
6,167,911 B1 1/2001 Diamond
6,237,645 B1 * 5/2001 Pountney ..... 141/7
6,253,803 B1 7/2001 Nusbaumer et al.
6,379,200 B1 * 4/2002 Hartke et al. ..... 440/88 R
6,532,888 B1 3/2003 Enik

* cited by examiner

SYSTEM FOR REFUELING A MARINE VEHICLE WITHOUT SPILLAGE

BACKGROUND OF THE INVENTION

The present invention is directed toward a system for refueling motorized marine vehicles and more particularly, toward a system for preventing the fuel from spilling into the water as the marine vehicle is being refueled.

Motorized marine vehicles, such as boats, generally employ an internal fuel tank that stores the fuel used to supply power to the engine. The tank typically has a neck with an opening through which the fuel nozzle of a fuel source is inserted and extends so that the tank may be filled. The boat should include a vent stack or tube leading from the fuel tank of the boat to the exterior of the boat through a vent hole in the side of the boat. The vent hole allow for fumes to be vented from the tank. The vent hole also provides a visual indication if the fuel tank has been overfilled. That is, when the tank is full, the fuel will pour out of the vent stack and into the water. This creates an environmental problem in that the excess fuel pollutes the water. Furthermore, the excess fuel can also become a potential fire hazard as the fuel will not mix with the water and will float on top of the water where it remains combustible. Another problem that may occur when refueling a boat is that air may become blocked in the vent tube and fuel may spill even though the tank is not full.

Many devices have been developed that prevent the fuel from spilling into the water when the boat is being refueled. For example, U.S. Pat. No. 5,070,806 to Coster discloses a fuel overflow device for motorized boats. The device includes a tube that fits through the vent hole with a receptacle attached to the tube. Suction cups are attached to the receptacle. The suction cups are used to secure the receptacle to the boat. Any overflow fuel exits the vent hole, enters the tube, and is collected in the receptacle.

U.S. Pat. No. 5,715,876 to Burt discloses a spill containment device similar to the device disclosed in Coster. The device disclosed in Burt, however, does not disclose a tube the leads to a collection receptacle. Rather, the collection receptacle is secured directly below the vent hole so that any overflow fuel flows into the receptacle.

U.S. Pat. No. 6,532,888 to Enik discloses a fuel spill containment device for a motorized boat that collects fuel being spilled from the vent of a fuel tank. The device is secured to the side of the boat and covers the vent hole through which overflow fuel escapes.

None of the devices discussed above, however, appears to prevent or remedy the problem of the vent tube being blocked. Therefore, a need exists for a fuel spill container that prevents fuel from spilling into the water as a boat is being refueled when the spill occurs as the result of overfilling the tank and also prevents the tank from being filled improperly.

SUMMARY OF THE INVENTION

The present invention is designed to overcome the deficiencies of the prior art discussed above. It is an object of the present invention to provide a system for preventing fuel from spilling into the water as a boat is being refueled.

It is another object of the present invention to provide a refueling system that allows overflow fuel from a fuel tank of a boat to be drawn out using a vacuum source.

It is a further object of the present invention to provide a refueling system that allows fuel that overflows from the fuel tank of a boat to be collected and recycled.

In accordance with the illustrative embodiments demonstrating features and advantages of the present invention, there is provided a system for refueling a marine vehicle without spilling fuel into the water where a fuel tank is located within the vehicle, the tank having a filling tube and a vent tube secured thereto and a vent hole formed in the vehicle, the vent tube of the fuel tank being in fluid communication with the vent hole. The system comprises means in fluid communication with the vent hole of the marine vehicle for transporting any fuel located within the vent tube to a remote location, a vacuum source connected to the transporting means wherein the vacuum source is adapted to draw the fuel through the transporting means, and a receptacle in fluid communication with the vacuum source wherein the fuel is collected in the receptacle.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
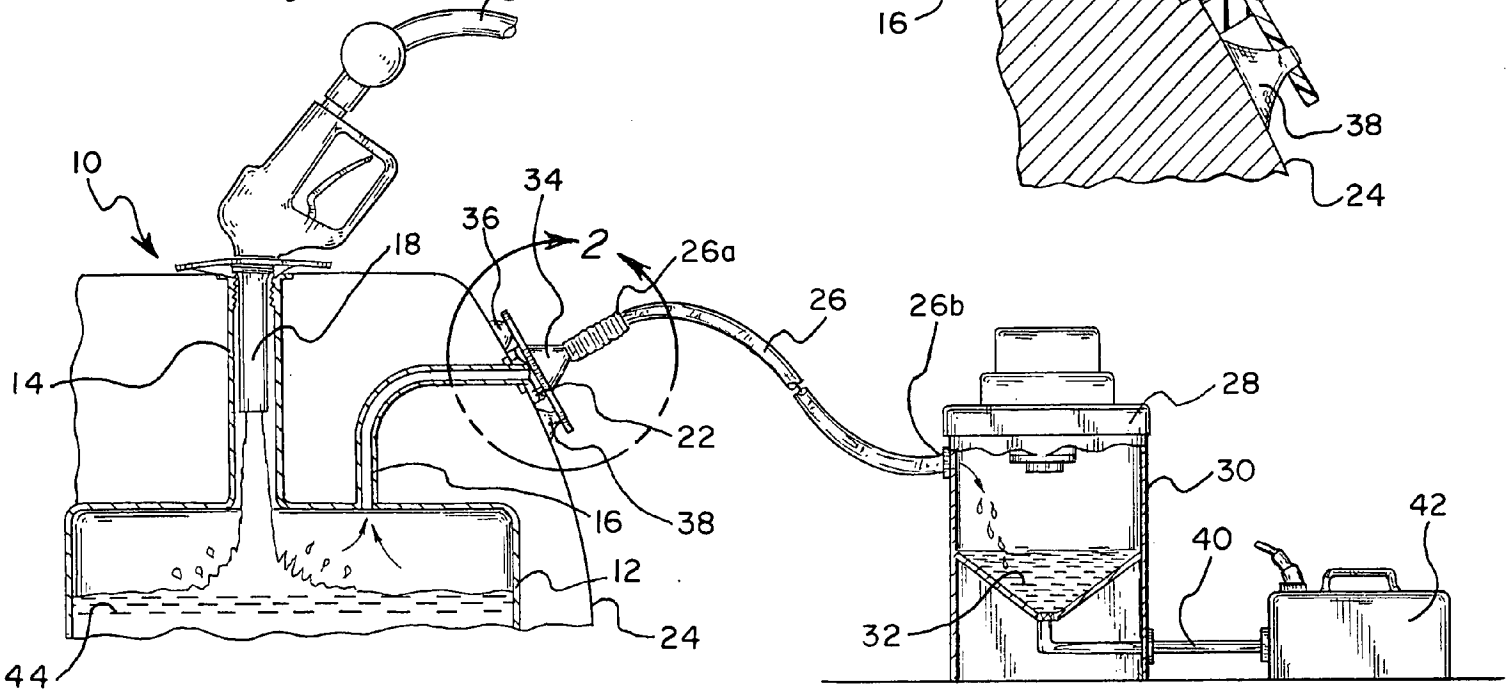
FIG. 1 illustrates the system of the present invention.

Referring now to the drawings in detail wherein like reference numerals have been used throughout the various figures to designate like elements, there is shown in FIG. 1 a system for preventing fuel from spilling while refueling a marine vehicle constructed in accordance with the principles of the present invention and designated generally as 10.

The present invention essentially includes a system for refueling a marine vehicle without spilling fuel into the water. A typical motorized marine vehicle includes a fuel tank 12 where the tank 12 has a filling tube 14 and a vent tube 16 secured thereto. The nozzle 18 of a fuel line 20 is inserted into the filling tube 14 in order to fill the tank 12. Excess or overflow fuel flows through the vent tube 16. The vent tube 16 is also used to vent fumes from the tank 12. The vent tube 16 is connected to or is otherwise in fluid communication with a vent hole 22 formed in the hull or side 24 of the boat. Often when the tank 12 is being fueled, overflow fuel escapes through the vent tube 16, out of the vent hole 22, and into the water.

The present invention seeks to prevent the spillage of fuel into the water and provides means 26 in fluid communication with the vent hole 22 of the marine vehicle for transporting any fuel located within the vent tube 16 to a location away from the vent tube 16 and vent hole 22, a vacuum source 28 connected to the transporting means 26 wherein the vacuum source 28 is adapted to draw the fuel through the transporting means 26, and a receptacle 30 in fluid communication with the vacuum source 28 wherein the overflow fuel 32 is collected in the receptacle 30.

Figure 2:
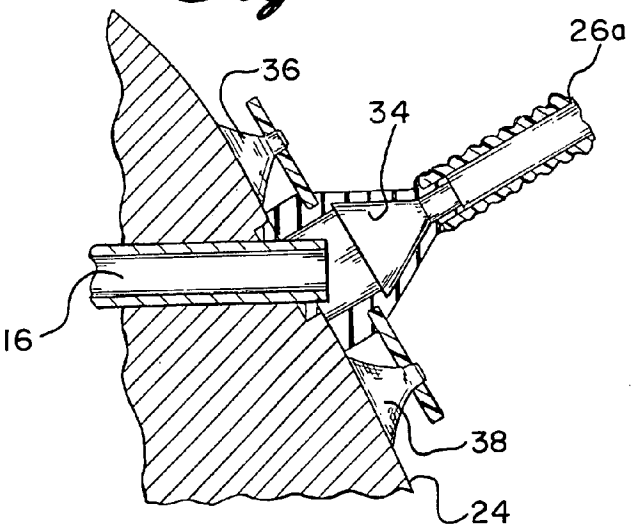
FIG. 2 is a cross-sectional view taken through line 2 of FIG. 1.

The transporting means 26 may be a transparent, flexible hose or tube that has a first end 26*a* and a second end 26*b*. The tube may be made from a rubber or similar type of material. The first end 26*a* is connected to a housing 34. The housing 34 is generally in the shape of a cup and is releasably secured to the exterior side 24 of the marine vehicle. The housing 34 may be secured to the vehicle via suction cups 36 and 38, for example. The housing 34 covers or generally surrounds the vent hole 22 and any part of the vent tube 16 that extends outwardly from the hole 22. (See FIG. 2.) The housing may be structured in such a manner as to accommodate vent holes of varying shapes and sizes.

Connected to the second end 26*b* of the tube 26 is the receptacle 30. Attached to the receptacle 30 is the vacuum source 28. (See FIG. 1.) Also attached to the receptacle 30 is a drain tube 40 that is connected to a storage container 42. While not shown, the receptacle 30 may also contain or be connected to a filtering system that can be used to remove impurities or to separate water from the fuel, for example. The storage container 42 may be used to ultimately collect the overflow fuel 32 that drains through the system. The receptacle 30 and storage container 42 may be located remotely from the tube 26 and the marine vehicle. For example, the receptacle, vacuum source, and storage container may be located on the dock.

In order to use the present invention, the nozzle18 of a fuel line 20 is inserted into the filling tube 14 so that fuel 44 may be pumped into the tank 12. The housing 34 is secured to the exterior 24 of the vehicle so that the vent hole 22 and any portion of the vent tube 16 extending therefrom are substantially covered by the housing 34. The vacuum 28 is activated so that any overflow fuel will be drawn through the tube 26 and into the receptacle 30 as the tank 12 is being filled. (See FIG. 1.) Because the tube is transparent, any flow of fuel therethrough may be observed. The presence of fuel in the tube indicates that the tank is full. The air in the vent tube will not become blocked and prevent the tank from filling properly because of the suction force being provided. Additionally, the vacuum aids in drawing fuel into the tank from the fuel source so that the tank is filled quickly and efficiently.

Once the overflow fuel 32 is collected in the receptacle 30, the fuel 32 may be siphoned into the container 42 and the fuel either cleaned and recycled or disposed of in an eco-friendly or environmentally safe manner.

Additionally, the present system may include audio and/or visual alarms that indicate that the tank is full and may automatically shut off the fuel pump. The vacuum, however, will continue to run and may be turned off manually. The system may also be a portable or permanent structure and may vary in size.

The present invention may be embodied in other specific forms without departing from the spirit or essential attributes thereof and accordingly, reference should be made to the appended claims rather than to the foregoing specification as indicating the scope of the invention.

I claim:

1. A system for refueling a marine vehicle without spilling fuel into the water where a fuel tank is located within the vehicle, the tank having a filling tube and a vent tube secured thereto and a vent hole formed in the vehicle, the vent tube of the fuel tank being in fluid communication with the vent hole, the system comprising:

means in fluid communication with the vent hole of the marine vehicle for transporting any fuel located within the vent tube to a location away from the vent tube;

a vacuum source connected to said transporting means wherein said vacuum source is adapted to draw the fuel through said transporting means; and a receptacle in fluid communication with said vacuum source wherein the fuel is collected in said receptacle.

2. The system for refueling a marine vehicle without spilling fuel into the water of claim 1 wherein said transporting means includes a housing and tube connected to said housing wherein said housing generally surrounds the vent hole.

3. The system for refueling a marine vehicle without spilling fuel into the water of claim 1 further including means for releasably securing said transporting means to the marine vehicle.

4. The system for refueling a marine vehicle without spilling fuel into the water of claim 3 wherein said securing means includes at least one suction cup.

* * * * *